US007144254B2

(12) United States Patent
Meyerrose

(10) Patent No.: US 7,144,254 B2
(45) Date of Patent: Dec. 5, 2006

(54) UNDERWATER WRITING TABLET

(76) Inventor: Kurt E. Meyerrose, P.O. Box 490, Alstead, NH (US) 03602

( * ) Notice: Subject to any disclaimer, the term of this patent is extended or adjusted under 35 U.S.C. 154(b) by 425 days.

(21) Appl. No.: 10/403,910

(22) Filed: Mar. 27, 2003

(65) Prior Publication Data

US 2004/0191753 A1 Sep. 30, 2004

(51) Int. Cl.
*B43L 1/00* (2006.01)

(52) U.S. Cl. ..... 434/408; 434/415; 24/10 R; 24/11 CT

(58) Field of Classification Search ..... 434/408, 434/432, 415; 401/81, 243, 244, 245, 246, 401/247, 185; 248/442; 108/43; 24/10 R, 24/11 CT; D19/52; 211/69.5, 60.1
See application file for complete search history.

(56) References Cited

U.S. PATENT DOCUMENTS

| | | | | | |
|---|---|---|---|---|---|
| 181,973 | A * | 9/1876 | Parke | 434/415 |
| 262,757 | A * | 8/1882 | Fowler | 434/415 |
| 2,881,538 | A * | 4/1959 | Lewis | 434/408 |
| 2,990,308 | A * | 6/1961 | Goldstein | 156/278 |
| 3,593,856 | A * | 7/1971 | Zander | 211/69.5 |
| 3,781,536 | A * | 12/1973 | Naeseth et al. | 362/34 |
| 3,828,696 | A * | 8/1974 | Lockridge | 108/43 |
| 4,255,873 | A * | 3/1981 | Eberle | 434/82 |
| 4,287,676 | A * | 9/1981 | Weinhaus | 40/661.01 |
| 4,907,824 | A * | 3/1990 | Smirnoff | 281/45 |
| 5,083,242 | A | 1/1992 | Piotrowski | 362/34 |
| 5,137,453 | A * | 8/1992 | Hudson | 434/408 |
| 5,205,449 | A | 4/1993 | Davies | 224/152 |
| 5,207,582 | A * | 5/1993 | Michelson | 434/416 |
| 5,263,866 | A * | 11/1993 | Campbell | 434/416 |
| 5,360,342 | A * | 11/1994 | Pardner | 434/84 |
| 2004/0006850 | A1 * | 1/2004 | Wax | 24/10 R |

* cited by examiner

*Primary Examiner*—Dmitry Suhol
(74) *Attorney, Agent, or Firm*—David & Bujold, P.L.L.C.

(57) ABSTRACT

An underwater writing tablet/instrument apparatus comprising a writing tablet having a perimeter edge. A resilient protective border is secured to the perimeter edge of the writing tablet for protecting perimeter edge. A resilient elongate member has opposed first and second ends with the first end attached to the protective border while the second end has a writing instrument receiving component for retaining a desired writing instrument. The elongate member has an normal, unexpanded state and an expanded state in which the coil member is resiliently expanded to facilitate a diver writing on the writing tablet with the writing instrument.

16 Claims, 7 Drawing Sheets

UNDERWATER WRITING TABLET

FIELD OF THE INVENTION

The present invention relates to an improvement concerning a underwater writing tablet.

BACKGROUND OF THE INVENTION

Although writing slates and tablets are generally known in the art for writing underwater, there are a variety of problems associated with known writing slates and tablets. In particular, it is easy for the writing instrument to become dislodged or separated from the writing tablet and thus the writing instrument may become easily lost underwater. In addition, the exposed edges of the writing tablet may be sharp and thus cause harm or injury to either the diver or his/her diving equipment. In addition, the prior art writing tablets are generally cumbersome to utilize and do not readily assist a diver with writing underwater.

SUMMARY OF THE INVENTION

Wherefore, it is an object of the present invention to overcome the above noted drawbacks of prior art writing tablets.

Another object of the present invention is to provide a writing table which has a writing instrument that is integrally and permanently attached to the writing tablet so that the writing tablet and the writing instrument do not become separated from one another, especially during underwater use.

A further object of the present invention is to provide a writing instrument which is easy to manipulate and write on the writing tablet, while underwater, while at the same time still being permanently attached to the writing tablet so that the writing instrument does not become separated from the writing tablet.

Yet another object of the present invention is to provide a method of manufacturing the writing tablet so that the writing instrument can be easily permanently attached to the writing tablet, during the manufacturing process, yet still facilitate easy replacement of the writing instrument when necessary.

Still another object of the present invention is to provide a method of manufacturing the writing tablet and the writing instrument during a two step manufacturing process in which the writing tablet is manufactured during the first step and the molded writing tablet is then placed in a second mold to integrally form the combined writing tablet/instrument apparatus in which the resilient protective border is molded integrally with the writing tablet.

The present invention relates to an underwater writing tablet/instrument apparatus comprising a writing tablet having a perimeter edge; a resilient protective border being secured to the perimeter edge of the writing tablet for protecting the perimeter edge; a resilient elongate member having opposed first and second ends, the first end being attached to the protective border while the second end having a writing instrument receiving component for retaining a desired writing instrument, and the elongate member having an normal unexpanded state and an expanded state in which the coil member is resiliently expanded to facilitate writing on the writing tablet with the writing instrument.

The present invention also relates to a method of manufacturing a writing tablet/instrument apparatus for writing underwater, the method comprises the steps of providing a writing tablet with a perimeter edge; securing a resilient protective border to the perimeter edge of the writing tablet for protecting the perimeter edge; providing a resilient elongate member with opposed first and second ends, attaching the first end of the elongate member to the protective border and forming a writing instrument receiving component in the second end for retaining a desired writing instrument thereby, and the elongate member having an normal unexpanded state and an expanded state in which the coil member is resiliently expanded to facilitate writing on the writing tablet.

BRIEF DESCRIPTION OF THE DRAWINGS

The invention will now be described, by way of example, with reference to the accompanying drawings in which.

DETAILED DESCRIPTION OF THE INVENTION

Figure 1:
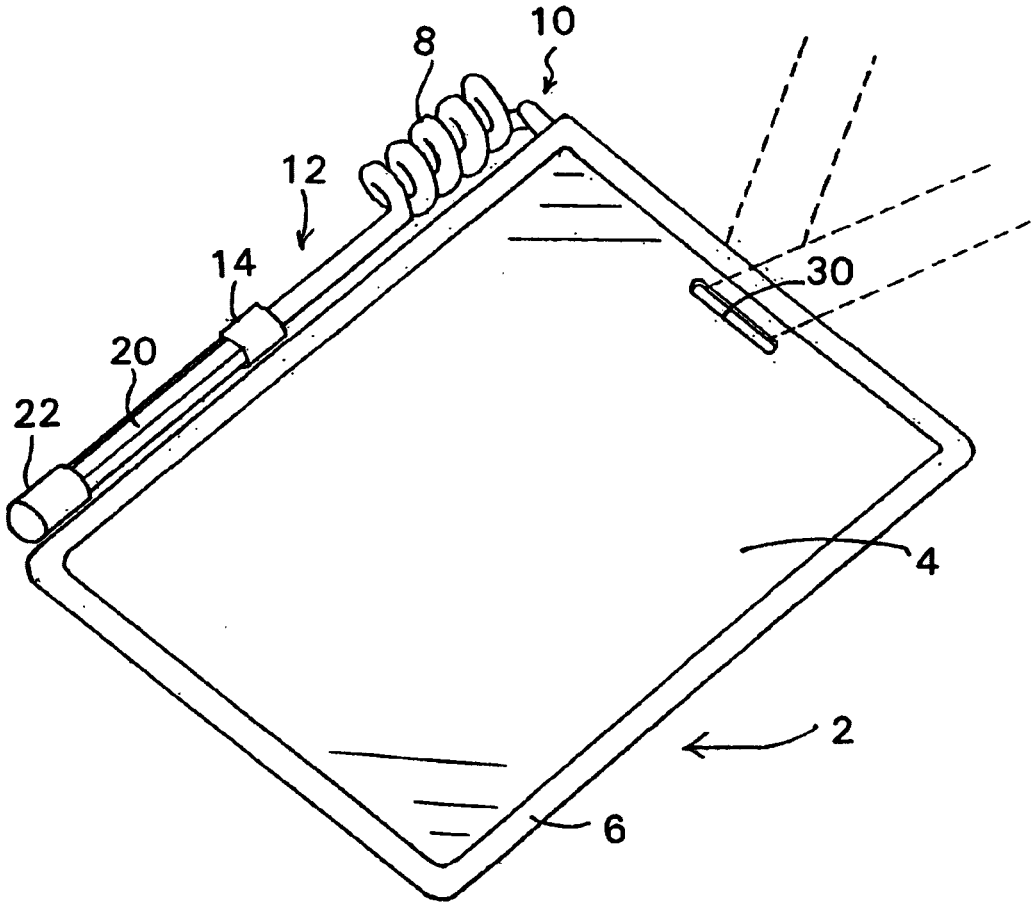
FIG. 1 is a perspective view of the improved writing tablet/instrument apparatus according to the present invention.
Figure 5A:
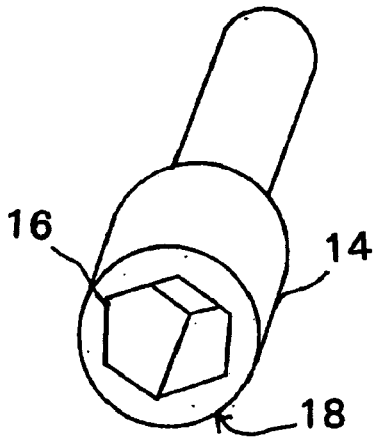
FIG. 5A is an exploded perspective view of the instrument cavity depicting a hexagonal transverse cross section.
Figure 7:
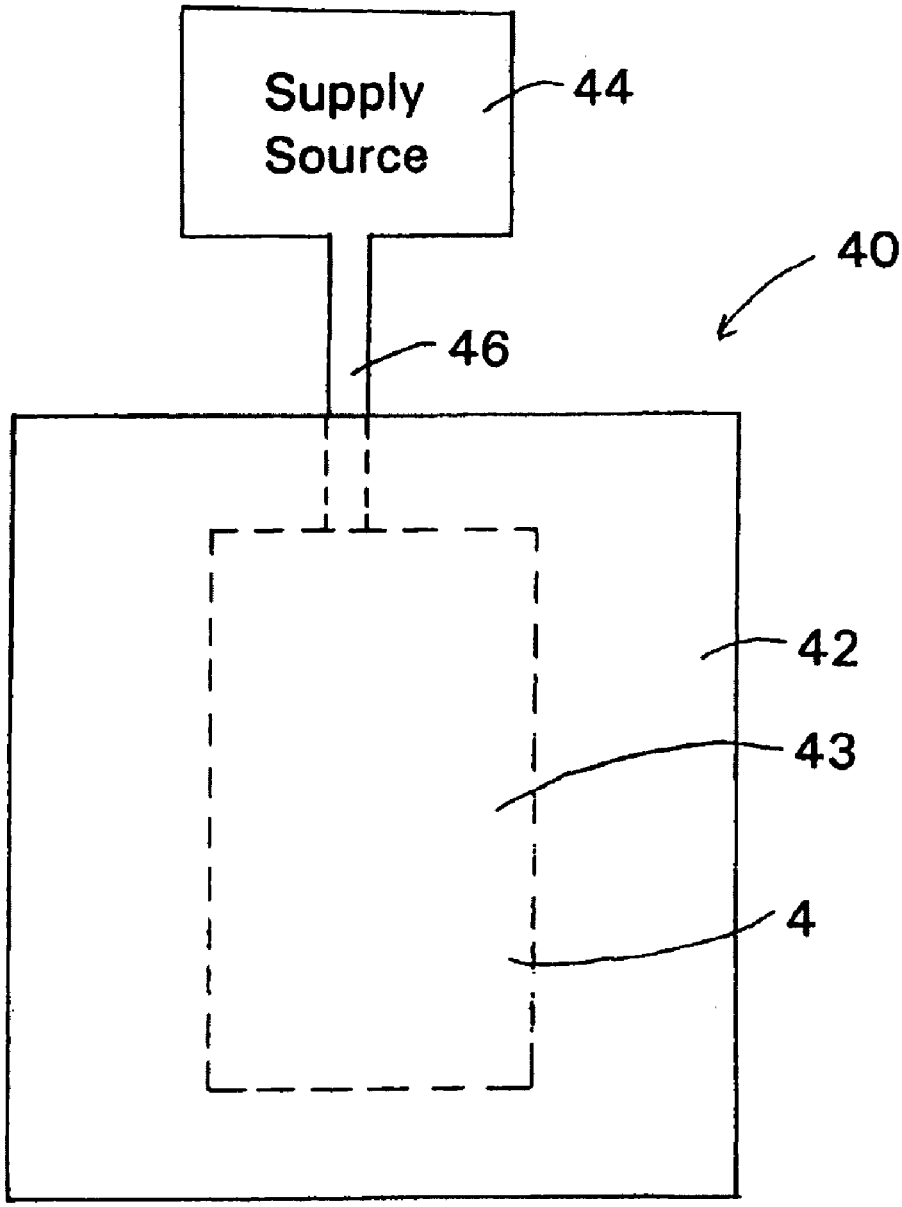
FIG. 7 is a diagrammatic representation of a first injection mold suitable for molding the writing tablet.

Turning now to FIGS. 1–6, a detailed description concerning the writing tablet/instrument apparatus 2 present invention will now be provided. As can be seen in FIG. 1, the writing tablet/instrument apparatus 2 generally comprises a writing tablet 4 having an integral perimeter edge 7 (see FIG. 7) along the perimeter of the writing tablet 4. A first end 10 of a resilient elongate member 8 is integrally attached to a protective border 6 of the integral perimeter edge 7 while a second end 12 of the elongate member 8 supports a writing instrument receiving component 14. The writing instrument receiving component 14, as shown in this embodiment, is generally an instrument cavity 16 formed in the second end 12 of the elongate member 8 and the opening 18 of the instrument cavity 16 of the writing instrument receiving component 14 is slightly undersized or smaller than an exterior dimension or diameter of the writing instrument 20 so that when the writing instrument 20 is received within the instrument cavity 16 of the writing instrument receiving component 14, the inwardly facing surface of the instrument cavity 16 expands radially outwardly slightly and frictionally engages with the exterior surface of the writing instrument 20 and also creates a vacuum to retain the writing instrument 20 in mating engagement with the instrument cavity. In a preferred form of the instrument cavity 16, the transverse cross section of the cavity is hexagonal in shape (see FIG. 5A) to closely mate or conform with the transverse cross section of a conventional pencil or pen.

Figure 2:
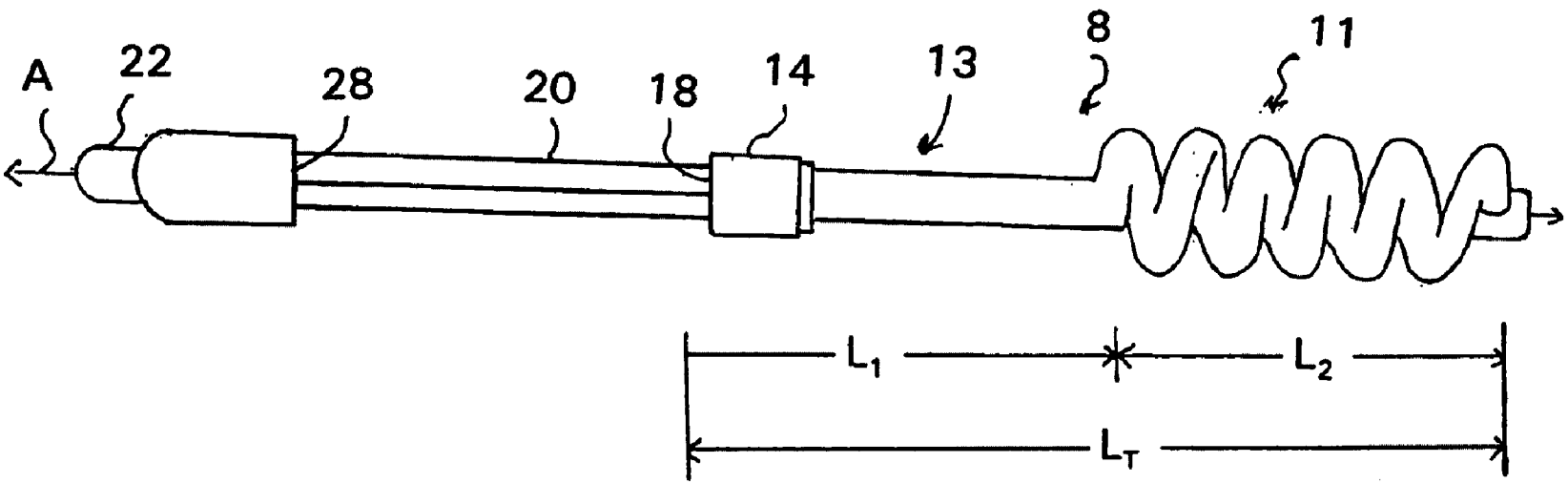
FIG. 2 is a diagrammatic left side elevational view of FIG. 1.
Figure 3:
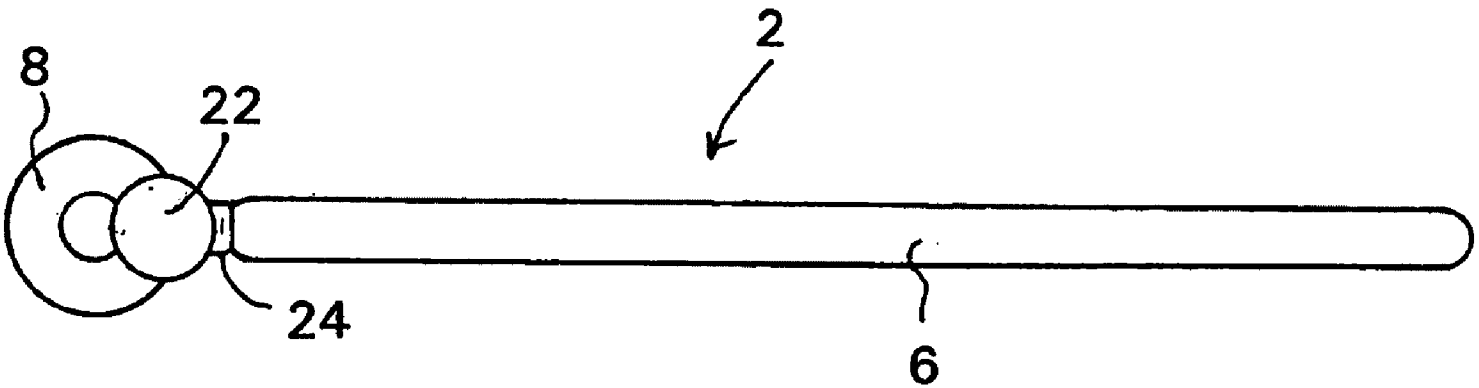
FIG. 3 is a diagrammatic top plan view of FIG. 1.
Figure 4:
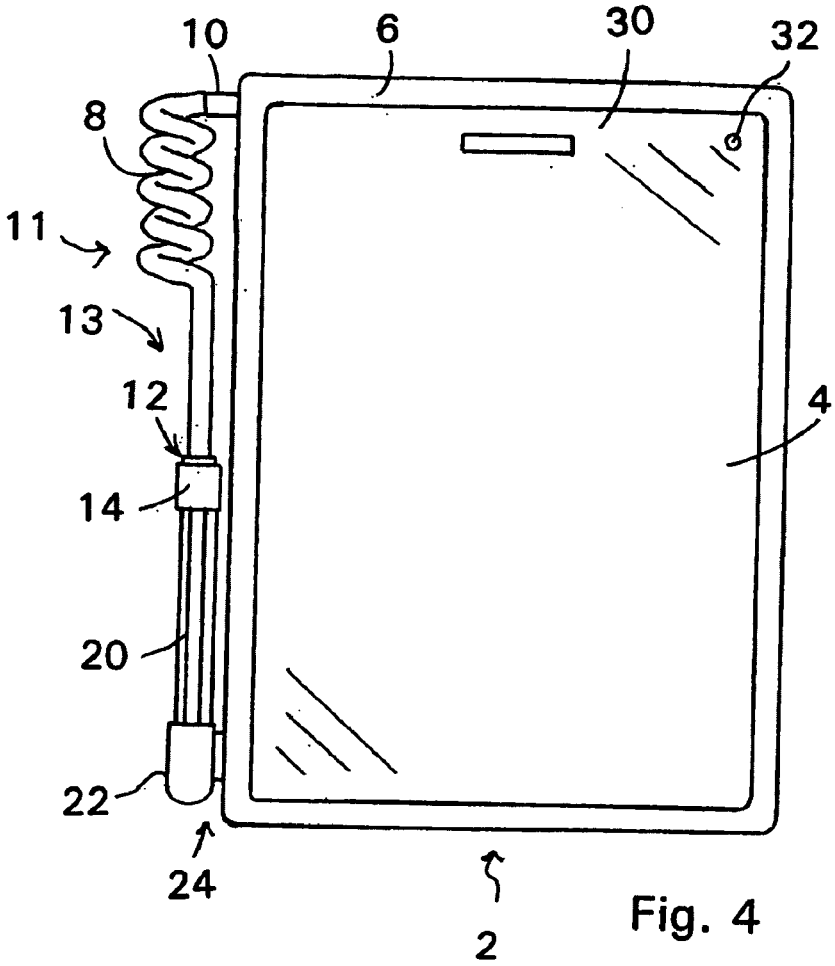
FIG. 4 is a diagrammatic front elevational view of FIG. 1 the rear view being a mirror image thereof.
Figure 5B:
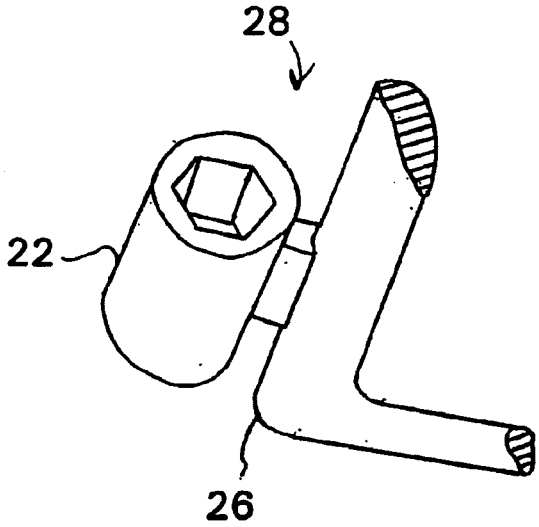
FIG. 5B is an exploded perspective view of the tip cavity depicting a hexagonal transverse cross section.
Figure 5:
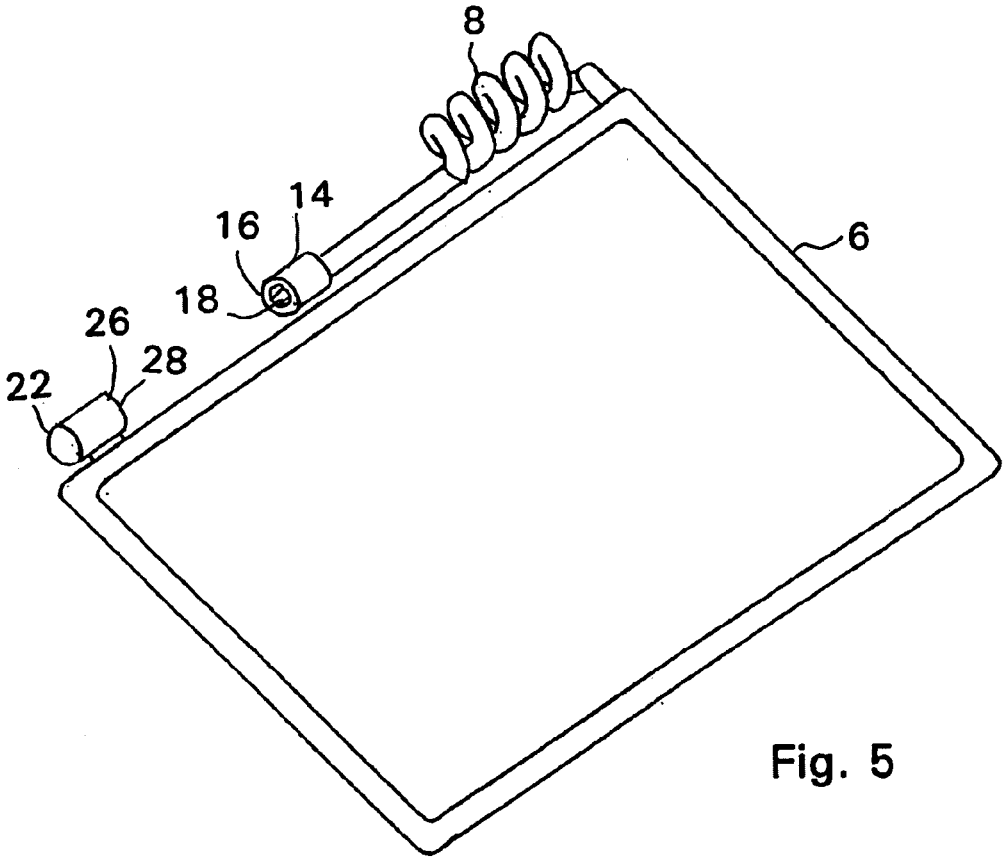
FIG. 5 is a diagrammatic perspective view of the protective border which is subsequently integrally molded with the writing tablet to form the writing tablet/instrument apparatus.
Figure 6:
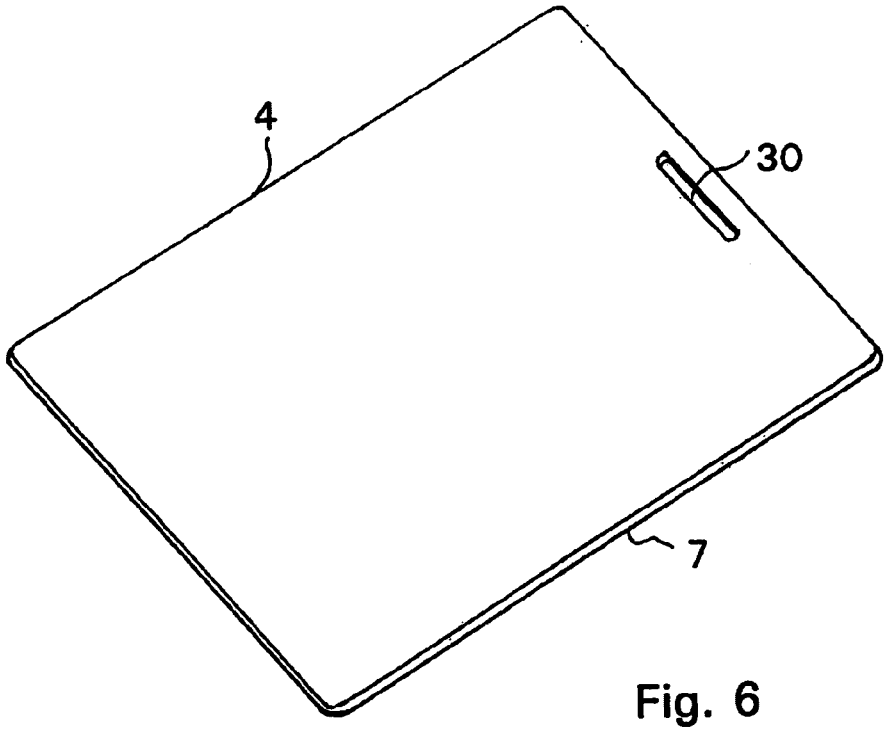
FIG. 6; is a diagrammatic perspective view of the writing tablet of FIG. 1 prior to forming the writing tablet into the writing tablet/instrument apparatus by the subsequent molding process.

The protective border 6 also includes a tip receiving component 22 but the tip receiving component 22 is sufficiently spaced from the attachment of the first end 10 of the elongate member 8 to the protective border 6. The tip receiving component 22, as shown in this embodiment, is generally a protrusion 24 extending radially away from a perimeter edge of the protective border 6 and the protrusion 24 has a tip cavity 26 formed therein with an opening 28 of the tip receiving component 22 being slightly undersized or smaller than an exterior dimension or diameter of the writing instrument 20 so that when the writing instrument 20 is received within the tip cavity 26 of the tip receiving component 22, the inwardly facing surface of the tip cavity 26 expands radially outwardly slightly and frictionally engages with the exterior surface of the writing instrument 20 and also creates a vacuum therein to retain the writing instrument 20 in mating engagement with the tip cavity 26. As can be seen in FIG. 2, for example, the tip receiving component 22, the writing instrument 20 and the elongate member 8 are generally aligned with one another along an axis A which extends parallel to one of the longitudinal edges 7 of the writing tablet 4. In a preferred form of the tip cavity 26, the transverse cross section of the cavity is hexagonal in shape (see FIG. 5B) to closely mate or conform with the transverse cross section of the tip of a conventional pencil or pen.

The writing tablet 4 is preferably provided with an elongate webbing slot 30 to facilitate attachment of the writing tablet/instrument apparatus 2 to a desired supporting strap (shown in phantom) for supporting the writing tablet/instrument apparatus 2 underwater about an arm, neck, shoulder, etc., of a diver. The elongate 30 slot has a typical length of between ⅝ of an inch and 1 ⅛ inches, preferably about 1 inch, and has a width of between ⅛ and ¼ of an inch, preferably about 3/16 of an inch. In addition, if desired, a hole 32, e.g., a circular or oval shape opening, may be provided in one quadrant of the writing tablet 4 to facilitate supporting of writing tablet/instrument apparatus 2 by a string, rope, wire, hook, chain, etc., or storage of the writing tablet/instrument apparatus 2 on an hook or nail, for example, when not in use.

The writing tablet 4 is generally rectangular in shape and has a length of between 2 and 24 inches, more preferably the writing tablet 4 has a length of between 5 and 14 inches, and most preferably the writing tablet 4 has a length of about 7 inches. The writing tablet 4 preferably has a width of between 2 inches and 10 inches, more preferably a width of between 4 inches to 9 inches and preferably a width of about 5 inches. The writing tablet 4 preferably has a thickness of between a 1/16 of an inch to about ½ of an inch, more preferably a thickness of about 3/32 of an inch to ⅜ of an inch, and most preferably a thickness of about ⅛ of an inch. The writing tablet 4 is manufactured from a material selected from the group comprising rigid polymers, such as high impact polystyrene (HIPS), acrylionitrile butadiene styrene (ABS) and polycarbonate (PC), with a molecular structure which is readily able to be coupled or bonded with non-rigid polymers. In addition to the above, as would be apparent to those skilled in this art, there are a variety of other known materials which would be suitable for forming the writing tablet 4 in accordance with the teachings and disclosure of the present invention.

A first portion 11 of the elongate member 8, located proximate the first end 10, has a plurality of coils, e.g., generally between 3 and 8 coils and more preferably between 4 and 6 coils and preferably 5 coils while a second portion 13 of the elongate member 8, located proximate the second end 12, e.g., a second half of the coil member 8, is straight or linear and does not contain any coils. The first portion 11 has an unexpanded length $L_2$ of about ½ to about 3 inches, more preferably about ⅜ to about 2 inches and most preferably about 1 ½ inches while the second portion 13 of the coil member 8 has an unexpanded length $L_1$ of about 1 to 4 inches and preferably about 2 inches or so. The unexpanded total longitudinal length $L_T$ of the elongate member 8 is about 4 to about 9 inches, depending upon the size of the writing tablet, while the expanded length of the elongate member 8 is about 8 to about 24 inches or so. By tugging on the writing instrument 20, the coils of the elongate member 8 straighten and extend the total length $L_T$ of the elongate member 8 to facilitate a diver writing, on the writing tablet 4, with the writing instrument 20 so that a user of a writing tablet/instrument apparatus 2 can easily mark any location on the writing tablet 4, with the writing instrument 20, without undue restriction from the elongate member 8. The diameter of the elongate member 8 is between 1/16 of an inch and ½ inch and more preferably about 3/16 of an inch.

The protective border 6 is manufactured from a material selected from the group comprising flexible polymers, such as thermoplastic elastomers (TPE) and thermoplastic rubber (TPR), namely olefinic type, styrenic type or polyrethane type polymers, with molecular structures which readily couple or bond with a rigid polymer. In addition to the above, as would be apparent to those skilled in this art, there are a variety of other known materials which would be suitable for forming the protective border 6 and elongate member 8 for encasing the writing tablet 4. The protective border 6 typically has rounded or curved exposed surfaces which do not have any sharp edges, surfaces or points which may possibly damage equipment and cause a cut or scrape to the diver. In addition, the protective border 6 is relatively soft material which readily deforms to facilitate absorbing impact in order to prevent injury or damage, when the writing tablet/instrument apparatus 2 abuts against a diver or some other object. The integral protective border 6 covers the entire perimeter of the writing tablet 4 and has a transverse cross section which is semioval or semicircular in shape and has radius of between about 1/16 to about ¼ of an inch and more preferably a radius of about ⅛ of an inch.

Each coil formed in the elongate member 8 generally has an outside diameter of between ⅜ of an inch and 1½ inches, more preferably the elongate member 8 has a diameter of between ½ of an inch and 1 inch, and most preferably the elongate member 8 has a diameter of about ¾ of an inch. The elongate member 8 is manufactured from a material selected from the group comprising flexible polymers, such as thermoplastic elastomers (TPE) and thermoplastic rubber (TPR), namely olefinic type, styrenic type or polyrethane type polymers, as would be apparent to those skilled in this art, there are a variety of other known materials which would be suitable for forming the elongate member 8. Preferably the elongate member 8 is manufacture from the same material used to manufacture the protective boarder 6.

In another embodiment not shown, the protective border 6 removably encases the perimeter edge 7 of the writing tablet 4, such that the protective border 6 may be removed and replaced with another protective border 6 possibly of a different color.

While the writing instrument receiving component 14 and the tip receiving component 22 are both shown as cavities, it is to be appreciated that a variety of other known ways of attaching a first end of a writing instrument to the free end of the elongate member 8 are possible and readily achievable. For example, the writing instrument 20 and the writing instrument receiving component 14 could have mating male and female screw threads to facilitate releasable attachment of those two components with one another. Alternatively, a remote end of the writing instrument 20 could carry a first releasable locking element and the writing instrument receiving component 14 could carry a second mating releasable locking element to facilitate releasable attachment of those to components with one another. As there are a variety of conceivable other ways for attaching the writing instrument 20 to the writing instrument receiving component 14 to facilitate secure, but releasable, attachment thereto which would be readily apparent to those skilled in the art, a further detailed description concerning the same is not provided. Nevertheless, such variations are still considered to be within the spirit and scope of the present invention Method of Manufacturing the Writing Tablet/Instrument Apparatus With reference to FIG. 7, one method for manufacturing the writing tablet/instrument apparatus 2, according to the present invention, will now be described. As can be seen in that Figure, the writing tablet 4 is molded by conventional injection molding equipment 40. The mold 42 is closed and the conventional injection molding equipment 40 is activated so that the mold 42 is filled with a desired molten material from a supply source 44. The desired molten material flows from the supply source 44 through a supply duct 46 to the molding equipment 40 and fills the entire cavity 43 of the mold 42. After a sufficient amount of molten material is supplied to the cavity 43 of the mold 42, the molten material is thereafter allowed to sufficiently hardened or set up. Next, the mold 42 of the molding equipment 40 is opened, in a conventional manner, and the writing tablet 4 is then removed from the mold 42. It is to be appreciated that the writing tablets 4 can be individually manufactured one at a time or a plurality of identical writing tablets can be simultaneously manufactured with one another during a single molding operation.

Figure 8:
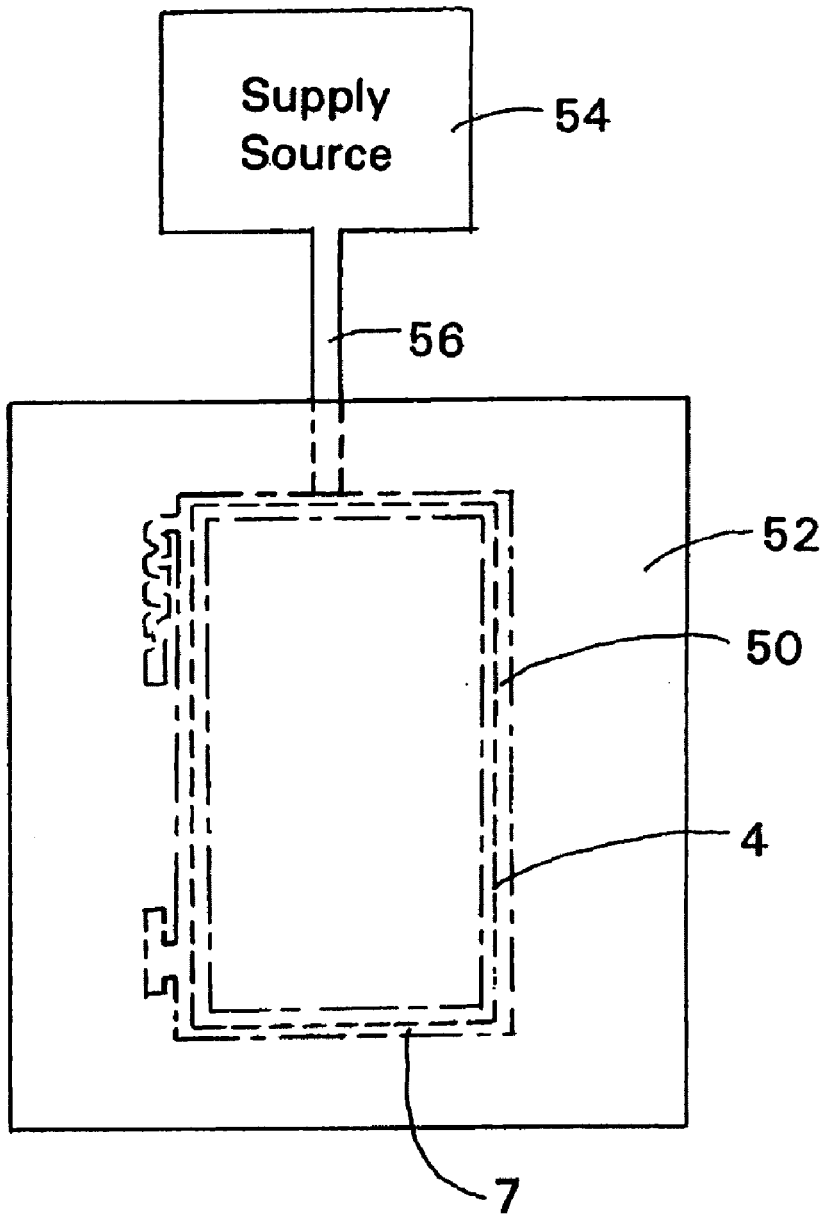
FIG. 8 is a diagrammatic representation of a second injection mold suitable for receiving the molded writing tablet and facilitate molding of the writing tablet/instrument apparatus.

Following molding of the writing tablet 4, the writing tablet 4 is then placed into a cavity 50 of second suitable injection molding equipment 52 (see FIG. 8) to complete manufacture of the writing tablet/instrument apparatus 2. After placing or loading the writing tablet 4 within injection molding equipment 52 such that it is entirely received within the cavity 50, the molding process is then activated so that the cavity 50, of the injection molding equipment 52, is filled with a desired molten material from a supply source 54. The molten material, as it flows from the supply source 54 through a supply duct 56 and into the cavity 50, surrounds, meshes with and encapsulates the exposed perimeter edge 7 of the writing tablet 4 accommodated within the injection molding equipment 52. After a sufficient amount of molten material is supplied to the cavity 50, the molten material is allowed to sufficiently hardened or set up and couple or bond with the exposed perimeter edge 7 of the writing tablet 4. Finally, the cavity 50 of the injection molding equipment 52 is opened and the writing tablet/instrument apparatus 2 is then removed from the injection molding equipment 52. It is to be appreciated that the writing tablet/instrument apparatus 2 can be individually manufactured, one at a time, or a plurality of writing tablet/instrument apparatus 2 can be simultaneously manufactured with one another during a single molding operation.

Following molding of the writing tablet/instrument apparatus 2, the entire writing tablet/instrument apparatus 2 is then allowed to sufficiently cool prior to removing the writing tablet/instrument apparatus 2 from the mold. Thereafter, a suitable writing instrument 20, e.g., a pen, a pencil, etc., can be attached to the instrument cavity 16 and the completed writing tablet/instrument apparatus 2 may be individually packaged or packaged together in desired quantities and thereafter distributed for sale.

Preferably, the writing tablet/instrument assembly 2 is manufactured so that writing can occur on both opposed sides of the writing tablet 4. That is, the writing tablet/instrument assembly is reversible so that it can be easily used by either right-handed or left-handed divers.

Since certain changes may be made in the above described improved writing tablet/instrument apparatus, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. An underwater writing tablet/instrument apparatus comprising:

a writing tablet having a perimeter edge;

a resilient protective border being secured to the perimeter edge of the writing tablet for protecting the perimeter edge;

a resilient elongate member having opposed first and second ends, the first end of the resilient elongate member being integrally molded with the protective border while the second end having a writing instrument receiving component for retaining a desired writing instrument and releasably securing the writing instrument to the resilient protective border, and the elongate member having an normal unexpanded state and an expanded state in which a coil member is resiliently expanded to facilitate writing on the writing tablet with the writing instrument;

the protective border further comprises a tip receiving component for retaining a tip of the writing instrument when attached to the instrument receiving component, and the tin receiving component is located in a spaced relationship to the attachment of the first end of the resilient elongate member to the protective border;

the writing instrument receiving component is an instrument cavity which has an opening slightly smaller in size than the exterior diameter of the writing instrument so that the instrument cavity frictionally engages with a remote end of the writing instrument and retains the writing instrument in engagement with the instrument cavity; and the instrument cavity has a hexagonal shaped transverse cross section.

2. The underwater writing tablet/instrument apparatus according to claim 1, wherein, when the writing instrument is received by the tip receiving component, the writing instrument and the coil member are both substantially aligned with one another and extend parallel to a longitudinal edge of the writing tablet.

3. The underwater writing tablet/instrument apparatus according to claim 1, the tip retaining component is a tip cavity which has an opening slightly smaller in size than the exterior diameter of the tip of the writing instrument so that the tip cavity frictionally engages with the tip of the writing instrument end retains the writing instrument in engagement with the tip cavity.

4. The underwater writing tablet/instrument apparatus according to claim 1, wherein the elongate member has a plurality of coils therein to facilitate resilient expansion of the elongate member into the expanded state and writing on the writing tablet with the writing instrument.

5. The underwater writing tablet/instrument apparatus according to claim 4, wherein each one of the plurality of coils of the elongate member has an outer diameter of between ⅜ of an inch and 1 inch.

6. The underwater writing tablet/instrument apparatus according to claim 4, wherein the elongate member has a diameter of between 1/16 of an inch and ½ of an inch;

between 3 and 8 coils are formed in the elongate member; and each one of the plurality of coils of the elongate member has an outer diameter of between ⅜ of an inch and 1½ inches.

7. The underwater writing tablet/instrument apparatus according to claim 1, wherein the writing tablet is manufactured from a rigid polymer with a molecular structure which bonds with a non-rigid polymer.

8. The underwater writing tablet/instrument apparatus according to claim 7, wherein the rigid polymer is selected from the group consisting of high impact polystyrene (HIPS), acrylionitrile butadiene styrene (ABS) and polycarbonate (PC).

9. The underwater writing tablet/instrument apparatus according to claim 1, wherein the protective border and the elongate member are manufactured from a flexible polymer with a molecular structure which bonds with a rigid polymer.

10. The underwater writing tablet/instrument apparatus according to claim 9, wherein the flexible polymer is selected from the group consisting of a thermoplastic elastomer (TPE) and thermoplastic rubber (TPR).

11. The underwater writing tablet/instrument apparatus according to claim 1, wherein the writing tablet is manufactured from a rigid polymer, and the protective border and the elongate member are manufactured from a flexible polymer with a molecular structure which bonds with the rigid polymer of the writing tablet.

12. The underwater writing tablet/instrument apparatus according to claim 1, wherein the writing tablet is provided with at least one opening therein to facilitate attachment of the writing tablet/instrument apparatus to a desired support member for supporting the underwater writing tablet/instrument apparatus to a diver.

13. The underwater writing tablet/instrument apparatus according to claim 1, wherein the writing tablet has a webbing slot therein, and an elongate strap engages with the webbing slot to facilitate transport of the underwater writing tablet/instrument apparatus.

14. An underwater writing tablet/instrument apparatus comprising:

a writing tablet having a perimeter edge;

a resilient protective border being secured to the perimeter edge of the writing tablet for protecting the perimeter edge;

a resilient elongate member having opposed first and second ends, the first end of the resilient elongate member being integrally molded with the protective border while the second end having a writing instrument receiving component for retaining a desired writing instrument and releasably securing the writing instrument to the resilient protective border, and the elongate member having an normal unexpanded state and an expanded state in which a coil member is resiliently expanded to facilitate writing on the writing tablet with the writing instrument;

the protective border further comprises a tip receiving component for retaining a tip of the writing instrument when attached to the instrument receiving component, and the tip receiving component is located in a spaced relationship to the attachment of the first end of the resilient elongate member to the protective border;

the writing instrument receiving component is an instrument cavity which has an opening slightly smaller in size than the exterior diameter of the writing instrument so that the instrument cavity frictionally engages with a remote end of the writing instrument and retains the writing instrument in engagement with the instrument cavity;

the tip retaining component is a tip cavity which has an opening slightly smaller in size than the exterior diameter of the tip of the writing instrument so that the tip cavity frictionally engages with the tip of the writing instrument and retains the writing instrument in engagement with the tip cavity; and the tip cavity has a hexagonal shaped transverse cross section.

15. The underwater writing tablet/instrument apparatus according to claim 14, wherein the coil member has a plurality of coils, each one of the plurality of coils of the coil member of the elongate member has an outer diameter of between ⅜ of an inch and 1 inch;

the writing tablet is manufactured from rigid polymer with a molecular structure which bonds with non-rigid polymer; and the protective border and the elongate member are manufactured from a flexible polymer with a molecular structure which bonds with the rigid polymer.

16. A method of manufacturing a writing tablet/instrument apparatus for writing underwater, the method comprises the steps of:

providing a writing tablet with a perimeter edge;

securing a resilient protective border to the perimeter edge of the writing tablet for protecting the perimeter edge;

providing a resilient elongate member with opposed first and second ends, molding the first end of the elongate member integrally with the protective border to form a single structure and forming a writing instrument receiving component in the second end for retaining a desired writing instrument thereby, and the elongate member having a normal unexpanded state and an expanded state in which a coil members of the resilient elongate member, is resiliently expanded to facilitate writing on the writing tablet; and forming a tip receiving component, for retaining a tip of the writing instrument when attached to the instrument receiving component, in a spaced relationship from the integrally molding of the first end of the resilient elongate member to the protective border, and the tip receiving component is a tip cavity which has an opening slightly smaller in size than the exterior diameter of the tip of the writing instrument so that the tip cavity frictionally engages with the tip of the writing instrument and retains the writing instrument in engagement with the tip cavity, and the tip cavity has a hexagonal shaped transverse cross section.

* * * * *